US005740841A

United States Patent [19]

Hirz

[11] Patent Number: 5,740,841

[45] Date of Patent: Apr. 21, 1998

[54] CAN FILLING APPARATUS

[76] Inventor: Donald J. Hirz, 835 Charles St., Willowick, Ohio 44095

[21] Appl. No.: 680,601

[22] Filed: Jul. 16, 1996

Related U.S. Application Data

[63] Continuation-in-part of Ser. No. 265,330, Jun. 24, 1994, Pat. No. 5,535,790.

[51] Int. Cl.[6] ..... B65B 3/00

[52] U.S. Cl. ..... 141/20; 141/369; 141/378

[58] Field of Search ..... 141/3, 20, 97, 141/369, 370, 375, 378

[56] References Cited

U.S. PATENT DOCUMENTS

| | | | |
|---|---|---|---|
| 1,590,299 | 6/1926 | Liddell | 141/97 |
| 1,858,793 | 5/1932 | Reynolds | 141/375 |
| 1,980,057 | 11/1934 | Horkavi | 141/369 |
| 2,142,827 | 1/1939 | Schultz et al. | 141/369 |
| 2,749,004 | 6/1956 | Hilts et al. | 141/375 |
| 2,914,096 | 11/1959 | Foresman, Jr. | 141/20 |
| 3,335,765 | 8/1967 | Moonan | 141/20 |
| 3,338,022 | 8/1967 | Moonan et al. | 53/36 |
| 3,444,906 | 5/1969 | Moonan et al. | 141/20 |
| 3,595,340 | 7/1971 | Obergfell | 184/27 |
| 3,765,459 | 10/1973 | Morse | 141/20 |
| 3,797,534 | 3/1974 | Skidmore | 141/3 |
| 4,321,953 | 3/1982 | Grothoff | 141/2 |
| 4,357,798 | 11/1982 | Hung | 417/468 |
| 4,632,281 | 12/1986 | Wold | 222/389 |
| 4,938,260 | 7/1990 | Hirz | 141/20 |
| 5,333,660 | 8/1994 | Kohlmann et al. | 141/263 |
| 5,348,048 | 9/1994 | Schirado et al. | 141/309 |
| 5,366,642 | 11/1994 | Platter et al. | 417/238 |
| 5,377,724 | 1/1995 | Ray | 141/20 |

*Primary Examiner*—J. Casimer Jacyna
*Attorney, Agent, or Firm*—Pearne, Gordon, McCoy & Granger LLP

[57] ABSTRACT

Apparatus for injecting material into an aerosol spray can that includes an improved can and pumping cylinder support arrangement. The arrangement simplifies the steps necessary to load and unload a can and offers a simplified construction for improved durability. The disclosed apparatus is compatible with cans of different size and affords a cabinet to contain the pumping process.

11 Claims, 4 Drawing Sheets

CAN FILLING APPARATUS

This is a continuation-in-part application of U.S. application Ser. No. 08/265,330, filed Jun. 24, 1994, now U.S. Pat. No. 5,535,790

BACKGROUND OF THE INVENTION

The invention relates to improvements in apparatus for injecting material into precharged aerosol spray cans.

PRIOR ART

U.S. Pat. Nos. 3,335,765, 3,338,022 and 3,444,906, the disclosures of which are incorporated herein in their entireties by reference, illustrate a general type of apparatus useful for introducing sprayable material into an aerosol spray can. Typically, the can has previously been pre-charged with a liquified and pressurized propellant gas. Such apparatus is useful in packaging paint or other material in applications where volume is low, ordinarily involving a single can or, possibly, a few cans with a specific formula of material to be introduced. The apparatus offers the convenience and quality of a spray applicator in these limited volume situations. Typically, apparatus of the type under consideration herein is used in retail and commercial paint stores and in hardware stores. It is important that the apparatus be safe and simple to use and reliable and durable in service in view of the often limited level of skill and experience possessed by the personnel involved in using the apparatus.

Versions of the prior art apparatus required certain extraneous clamping and unclamping actions to be performed with its components to load and unload a can and, in some cases, no provisions were available to accommodate cans of different size. The extra steps necessary to complete the charging activity could be overlooked or be improperly performed, thereby potentially resulting in a spill or damage to the can being charged. Some versions of the prior art apparatus had can clamping devices that were prone to become fouled with the material that was being dispensed into the cans. Consequently, the clamping parts required extra cleaning effort. Still further, some of the clamping devices were prone to premature wear and failure.

SUMMARY OF THE INVENTION

The present invention provides improved aerosol can charging apparatus that simplifies can loading and unloading steps and makes it easier to use than prior art devices. Additionally, the apparatus itself is simplified and thereby provides improved reliability of operation and extended service life. More specifically, in accordance with one aspect of the invention, the can is loaded into the apparatus after being coupled with a pumping cylinder body by simply sliding the body and can horizontally into a receiving zone, in the illustrated embodiment, formed by a slot in a support plate that embraces the cylinder body and restricts it against axial movement. The can is supported with a surface that has a predetermined spacing from the cylinder body support plate that accommodates a particular size of can with adequate vertical clearance to ensure smooth and unobstructed reception of the can into the apparatus. At the same time, the can support surface and cylinder body support plate assure that the can and cylinder body remain coupled during pump operation when a piston is manually driven up and down in the pump cylinder.

The apparatus of the invention also includes provisions for accommodating cans of different height. As disclosed, these provisions are in the form of a vertically adjustable shelf supported at a selected height on opposed walls that form part of the base of the apparatus. In the preferred embodiment, the base is formed, in part, by a three-sided cabinet on which is mounted a pivotal door to completely enclose a can being filled. The cabinet, while enclosing the can for purposes of fully containing the pumping process, advantageously serves as a main part of the framework of the apparatus. The illustrated cabinet is fabricated from sheet steel and is advantageously located and fixed to a base plate by integral depending tabs assembled through apertures in the base plate.

DESCRIPTION OF THE PREFERRED EMBODIMENT

Figure 1:
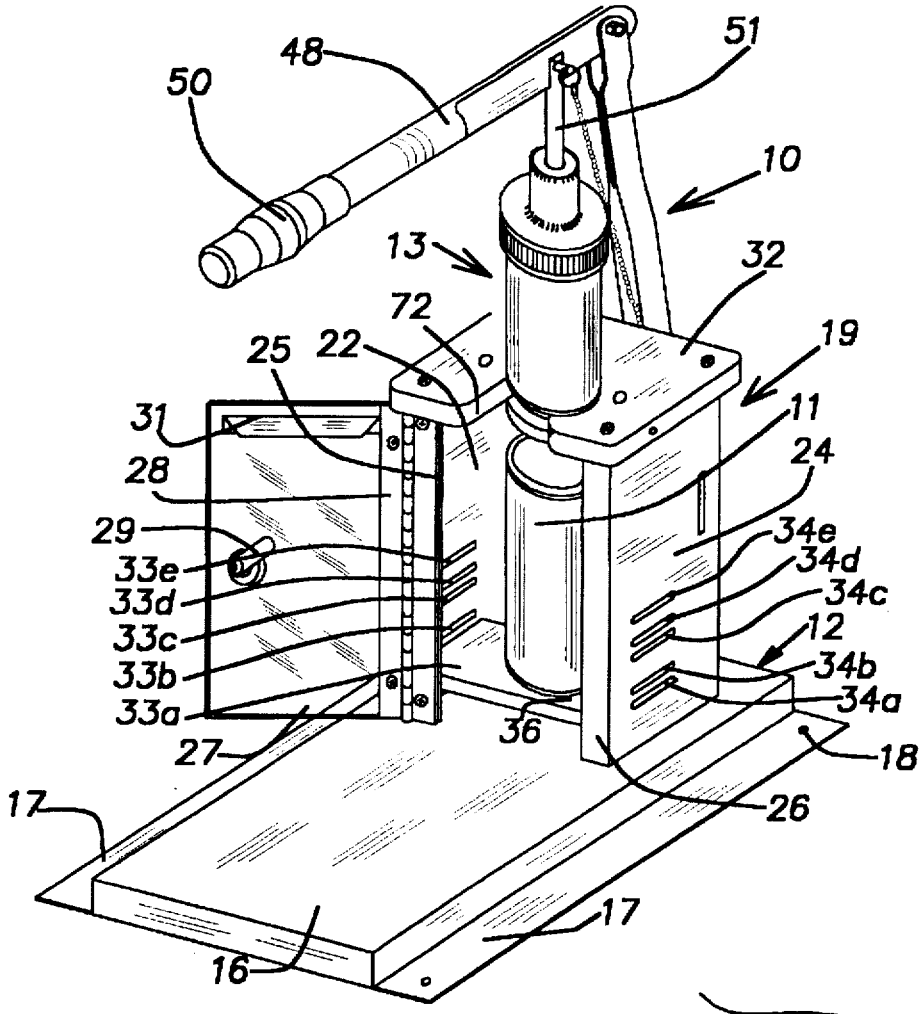
FIG. 1 is a perspective view of the apparatus of the invention.
Figure 7:
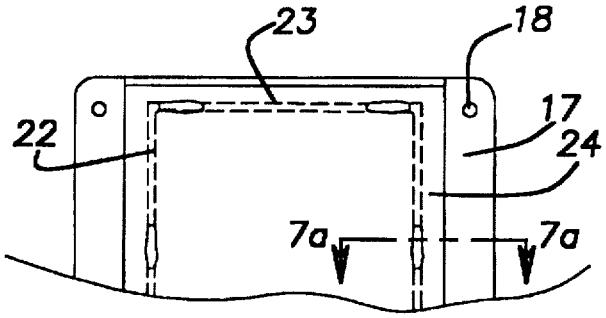
FIG. 7 is a view of the underside of the base of the apparatus.
Figure 7A:
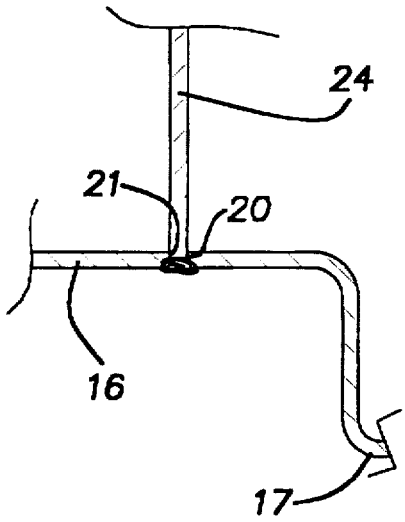
FIG. 7*a* is a fragmentary cross-sectional view of a portion of the base indicated in FIG. 7.

This is a continuation-in-part application of U.S. application Ser. No. 08/265,330, filed Jun. 24, 1994, now U.S. Pat. No. 5,535,790, the disclosure of which is incorporated in its entirety herein by reference.

Apparatus 10 for injecting sprayable material into an aerosol can 11 pre-charged with liquified pressurized gaseous propellant includes an assembled base 12 and a manually operated pump assembly 13. The base has a bottom 16 of sheet metal formed into an inverted rectangular pan shape including horizontal flanges 17. The flanges 17 have holes 18 for anchoring the apparatus to a bench or table surface with suitable fasteners. The base assembly 12 further includes a cabinet 19 that has three vertical walls 22–24 bent from a single sheet of steel. Opposed sidewalls 22, 24 each have an in-turned integral flange 25, 26 that is parallel to the intermediate or back wall 23. The cabinet walls have integral depending tabs 20 that are received in corresponding slots 21 in the base sheet 16. The walls are permanently locked to the base 16 by fusing or welding the steel of the tabs 20 in the slots 21. A transparent door 27 made of suitable material, such as acrylic, is secured to one of the flanges 25 by a piano-type hinge 28. The door 27 closes flush against the opposite flange 26 and is releasably held against it by a rotatable latch 29 that in one orientation engages the inside face of the flange 26. Adjacent its top edge, the door is fitted with a metal angle 31 that fits under a top plate or support 32 of the base 12 to catch any potential fluid spattering that could occur during the pumping operation.

Figure 4:
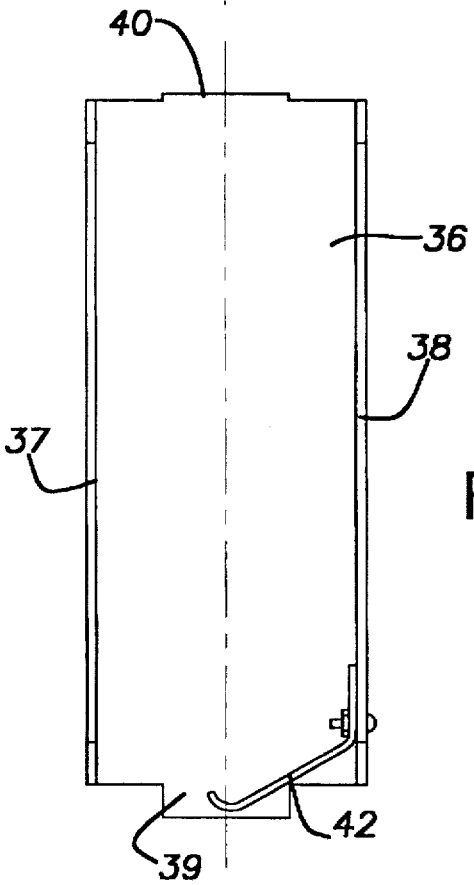
FIG. 4 is a view of an underside of a can support shelf.

A series of horizontal slots 33*a* through 33*e* and 34*a* through 34*e* are cut through the opposed cabinet walls 22, 24. The slots 33 of one wall 22 are paired with the slots 34 of the other wall 24 so that opposite pairs of the slots have the same height from the base platform 16. A movable can support shelf 36 is vertically adjustable within the cabinet 19 by manually positioning it in selected aligned pairs of the slots 33, 34. The shelf 36, fabricated from stainless steel sheet or other suitable material, has longitudinal downwardly extending stiffening flanges 37, 38 on its long sides and slot engaging tongues or tabs 39, 40 on its short sides. Screwed to the bottom of the shelf flange 38 is a leaf spring 42 that is adapted to engage the inner surface of one of the cabinet walls 22 or 24. The spring 42 is shown in its free state in FIG. 4. The shelf 36 and particularly its tabs or tongues 39, 40 are dimensioned to permit the long tongue to be inserted in a selected slot 33 or 34 first. Initially, the shelf is inclined from one side of the cabinet to the other, and then the long tongue 39 is fully inserted into the selected slot deflecting the spring 42. The shelf 36 is levelled and the spring 42 is allowed to shift the short tongue or tab 40 into the opposite paired slot and thereby maintain the shelf in this selected position. The importance of the height of the shelf is explained below.

A steel bracket 44 is welded on the rear face of the center or back cabinet wall 23 to carry a pivot pin or bolt for a link 47. The link 47, formed by a pair of bars welded together is forked at each end. At its lower end, the link is pivotally supported on the bolt 46 and at its upper end, the link carries a pump handle 48. The adjacent end of the handle 48 is pivotally connected to the link by a shoulder bolt 49. The handle 48 can be fabricated from steel tubing and can be fitted at its free end with a plastic or rubber hand grip 50.

Figure 2A:
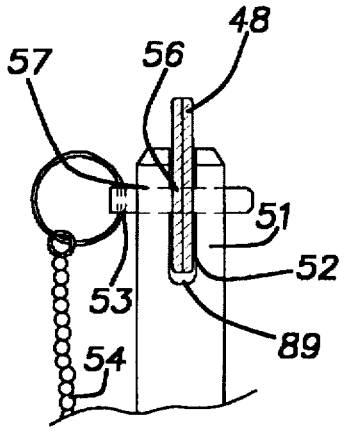
FIG. 2*a* is a fragmentary sectional view of a handle and piston of the apparatus taken in the plane indicated in FIG. 2.
Figure 2:
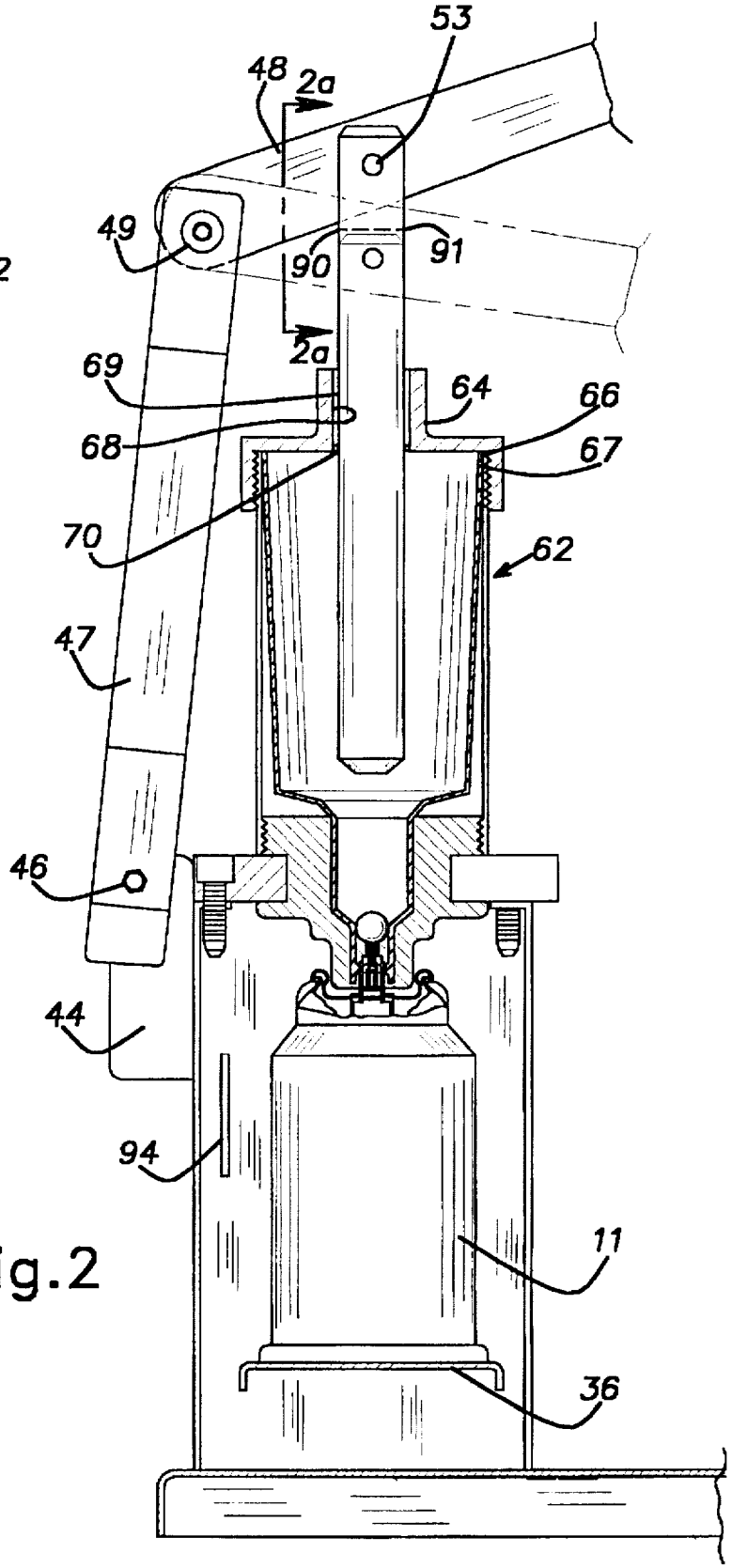
FIG. 2 is a vertical cross-sectional view of the apparatus.

A vertical piston 51, made of nickel-plated cold rolled steel, has a central vertical slot 52 in its upper end to receive a flattened part of the handle 48 (FIG. 2*a*). A ball detented pin 53, ideally on a ball chain lanyard anchored to the cabinet 19, pivotally and releasably joins the handle 48 to the piston 51 when it is inserted through respective cross holes 56, 57.

A lower end 58 of the piston 51 works in a pump cylinder bore 59 formed in a body 61. A reservoir 62 formed by the interior of a cylindrical tube 63 joined to the body 61 by suitable threads or other means communicates with the cylinder bore 59. In the illustrated embodiment, the reservoir tube 63 is threaded onto the exterior of the body 61. A circular cap 64 of aluminum or other suitable material is removably threaded onto the reservoir tube 63. Preferably, internal threads 66 on the cap 64 and external threads 67 on the reservoir tube 63 are complementary "4 start" threads, i.e. they comprise a quadruple helix. This thread arrangement gives a very quick thread start, not more than 90°, to stabilize the cap and full engagement can be accomplished with less than one full turn when the cap 64 is turned onto the reservoir tube 63. Additionally, the multiple thread arrangement ensures an adequate mounting of the cap 64 on the reservoir tube 63 with even a small angle of relative rotation once these threads are first engaged. A central bore 68 through the cap is fitted with a bronze bushing 69 and a wiper or washer 70 for guiding and wiping the piston 51 for vertical reciprocation along its axis.

The top plate or support 32 has a slot 72 that is open at the front side of the cabinet for receiving the cylinder body 61. The cylinder body 61 has a circular exterior that includes an external circumferential groove 73. The groove 73 has an inner diameter sized to fit closely within the slot 72 and has an axial length sized to fit closely with the thickness of the plate 32. The configuration of the cylinder body 61 and area of the plate 32 forming the receiving slot 72, when the body is received in the slot by lateral horizontal motion from the front of the cabinet, automatically restrains the cylinder body from any significant axial vertical movement in either direction. Radially extending faces 74, 75 of the cylinder body 61 are closely restrained axially by upper and lower faces 76, 77 of the top plate 32. Thus, when the cylinder body 61 is received in the slot 72, it is automatically locked in position against axial pumping forces. A spring loaded ball detent 78 is assembled in a bore in the mid-plane of the top plate 32 to engage the cylindrical surface of the groove 73 of the cylinder body 61 and releasably frictionally lock the cylinder body in place when it is fully horizontally manually pushed into the slot 72.

Figure 3:
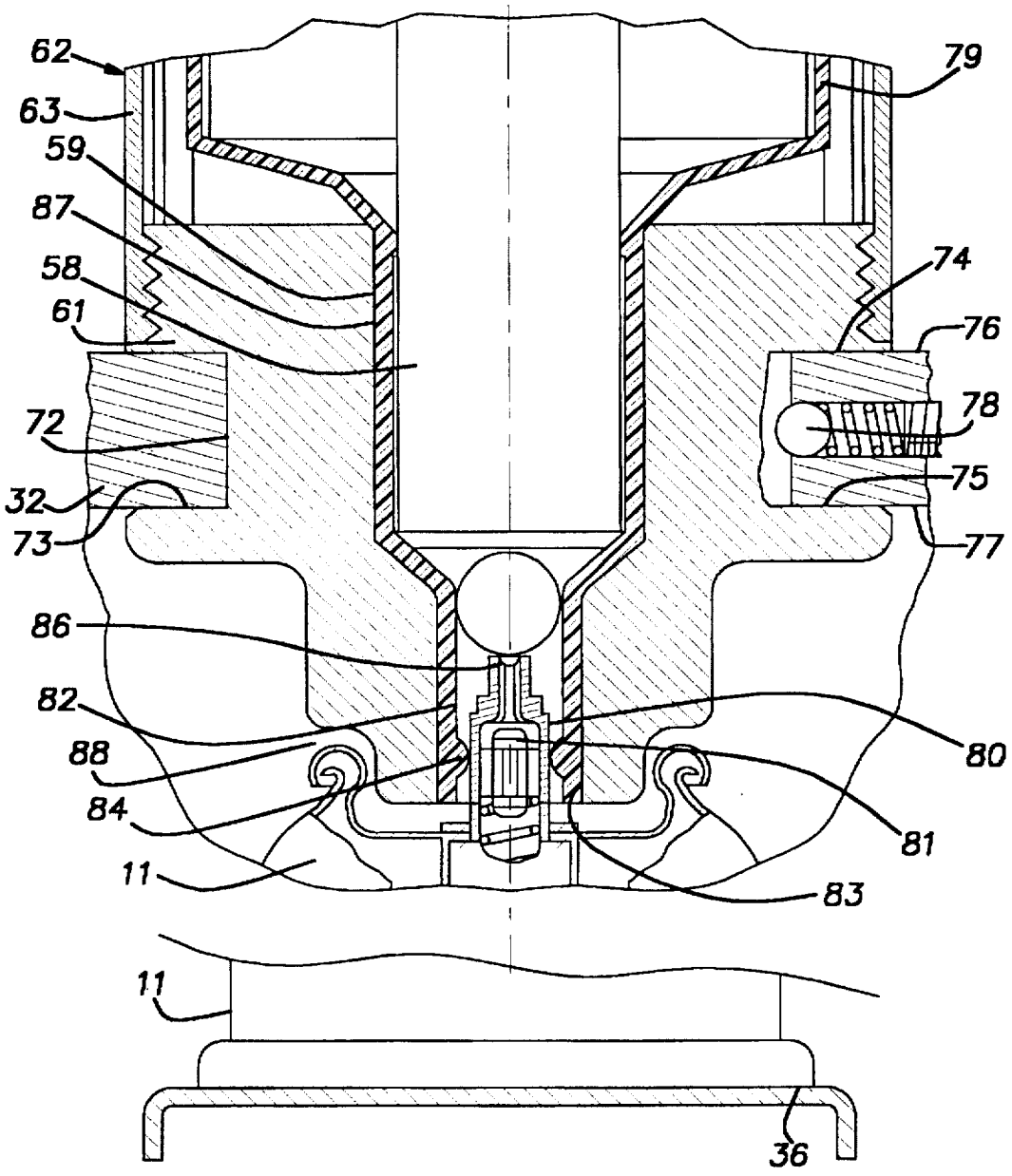
FIG. 3 is an enlarged fragmentary cross-sectional view of a pump cylinder body and coupled can top.

An injection-molded rigid funnel-shaped liner 79 is disposed in the bore of the cylinder or pump body 61 and in the reservoir 62. The liner 79 is useful, for example, when the apparatus 10 is used to charge paint into an aerosol can and it is desired to reduce the clean-up effort and time necessary. The illustrated aerosol can 11 has a discharge aperture in the form of a tube 80 at its upper end and a spring biased valve 81 in the tube. A portion 82 of the liner 79 in an outlet opening 83 for the cylinder bore 59 includes an internal integral bead 84 that is dimensioned to form a fluid-tight coupling fit on the exterior of the discharge tube 80 of the can 11. When the tube 80 is inserted in the outlet opening 83 and liner portion 82, the can 11 is coupled to the pump chamber bore 59. A ball 85 working like a gravity biased check valve, holds liquid in the reservoir 62 by sealing with the bead 84. When the tube 80 is inserted and the ball 85 is lifted away from the bead 84, liquid is allowed to flow through the outlet opening 83. A notch 86 in the side of the tube 80 ensures that the tube is not sealed by the ball 85. In FIG. 3, the valve 81 is shown in an open position which it will assume during pumping action of the piston 51 as a result of hydraulic forces produced by liquid being expelled by the piston. The lower end 58 of the piston 51 is dimensioned to fit into a part 87 of the liner 79 within the cylinder bore 59 with a substantially fluid-tight seal.

For operation of the apparatus 10, the liquid for charging the can 11 is placed into the reservoir and the cap 64 and piston 51 are assembled onto the reservoir. The can 11 is coupled to the pump cylinder 59 and the cylinder body 61 is then positioned in the slot 72 while the can is simultaneously received in the cabinet 19. The door 27 is closed and latched. The pin 53 is inserted to connect the handle 48 to the piston 51. The piston 51 is manually manipulated by hand force applied to the handle grip 50. The limits of motion of the piston 51 are preferably determined by the geometry of the slot 52 relative to the handle 48. A bottom 89 of the slot 52 of the piston 51 is rounded in a concave sense to compliment the adjacent convex rounded edges of the flattened part of the handle 48. Engagement of the handle 48 at an edge 90 of the slot 52 determines the upper limit of the stroke of the piston 51 and engagement of the handle with a slot edges 91 determines the lower limit of piston travel. At the upper piston position, the lower end of the piston 51 is clear of the lined portion of the pump chamber or bore 59 allowing liquid to flow by gravity into this chamber. Downward force on the handle 48 causes the piston to drive liquid from the bore 59 into the can 11. When the reservoir 62 and bore 59 are empty of liquid, this condition will be perceived by a reduction in the effort required to depress the handle 48. Ordinarily, the can 11 is fully charged at this time. The pin 53 can be pulled out of the piston 51 and handle 48 and, with the door open, the cylinder body 61 is removed from the slot 72 and the can 11 is simultaneously removed from the cabinet 19. The cylinder body 61 is thereafter lifted off the can, the liner is removed and disposed of and the various parts are wiped clean.

In accordance with an important aspect of the invention, the height of the shelf 36 is arranged to allow sufficient clearance for the can 11 to be easily inserted into the cabinet 19 below the cylinder supporting plate 32 and above the shelf while the interior of the can is coupled to the bore by the presence of the tube 80 in the cylinder outlet 83. In this preferred embodiment, the bead 84 is sufficiently tight around the tube 80 so as to allow the can to be suspended by frictional forces before the can is inserted in the cabinet. Typically, the can 11 and cylinder body 61 can be forced together with the tube 80 in the outlet 83 until a part of the can assembly other than the tube abut one another. Friction of the bead 84 on the tube 80 can hold this relative position of the can and cylinder body 61 while the can and cylinder body are loaded into the apparatus. In this abutted state between the can 11 and cylinder body 61, as the groove 73 of the body is pushed into the slot 72 there is, for example, at least 1/16" clearance between the bottom of the can and the top of the shelf 36. It will be understood that the extension of the tube 80 beyond the bead 84 is substantially greater than this clearance when the can top is abutted against the cylinder body 61. In FIG. 3, the can is shown abutting the shelf 36 and exemplary clearance is shown at 88.

Figure 6:
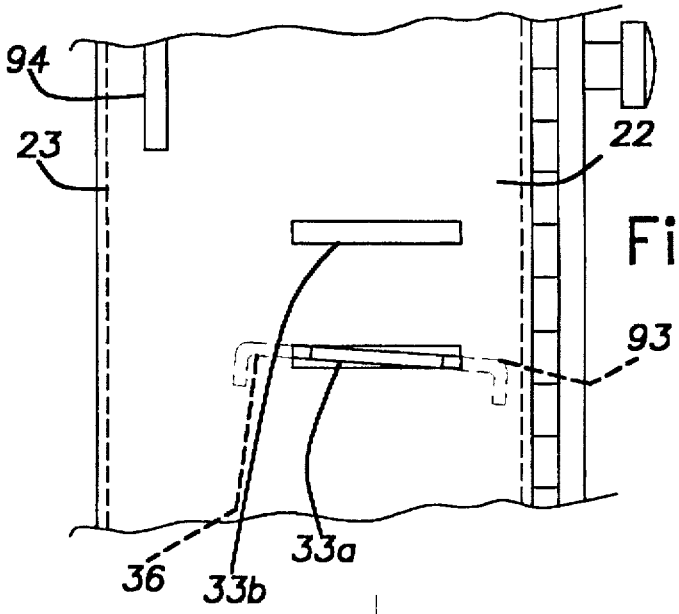
FIG. 6 is a fragmentary side elevational view of a cabinet sidewall and the can support shelf.
Figure 5:
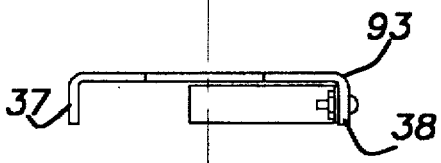
FIG. 5 is an end view of the support shelf.

Each pair of slots 33, 34 is provided to accommodate a different size can. All of the slots 33, 34 are wider in the vertical direction than the thickness of the metal stock forming the shelf tabs 39, 40. Additionally, as shown in FIG. 6, the edge of the shelf 36 at the front of the cabinet is cantilevered from the support of the shelf by the slots 33, 34. When a can 11 is being inserted into the cabinet 19, a curved edge 93 of the shelf 36 works as a cam to guide the can upwardly onto the shelf. At the same time, as shown in FIG. 6 the shelf edge 93 can tilt downwardly to a limited extent yielding extra clearance for entry of the can to the space between it and the top plate 32.

If the reservoir is supplied with a charge of material to be dispensed into more than one aerosol can, the first and subsequent cans can be removed from the apparatus without disassembling the handle from the piston by simply dropping the shelf either partially by removing the short tab from its respective slot and tilting the shelf downwardly or by fully removing the shelf by first slipping the short tab out, tilting the shelf downwardly and then removing the long tab. With the shelf out of the way, a charged can can be pulled downwardly until the tube 80 is free of the outlet 83 and then removed from the cabinet. A new can can then be positioned in the cabinet and pushed upwardly so that its tube 80 is coupled to the outlet opening 83. When large cans are used, the shelf 36 can be removed from the space directly under the piston to allow a can to rest directly on the base platform 16. In such cases, the shelf 36 can be stored by inserting the tongues 39, 40 in a pair of opposed vertical slots 94 near the rear or back wall of the cabinet.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

I claim:

1. Apparatus for injecting material to be sprayed into an aerosol can containing a liquified propellent gas under pressure, said can having a discharge valve at the top thereof, said apparatus comprising a base adapted to support an aerosol can to be filled in a vertical position, a cylinder member adapted to be supported on said base, said cylinder member having a vertical pumping bore and a reduced diameter outlet adapted to be coupled to the discharge valve of a can disposed on the apparatus, means for coupling the reduced diameter outlet to said valve, a piston operable in said pumping bore, means for reciprocating said piston within said pumping bore, and a reservoir disposed above said pumping bore and in communication with the upper end thereof for supplying material to be injected into said aerosol can to said pumping bore, a lower portion of the piston clearing the top of the pumping bore when the piston is at an upper limit of its travel whereby material will flow by gravity from the reservoir into said pumping bore, the base including a support for the cylinder member, the cylinder member support being arranged to receive and release the cylinder member with the reservoir by relative movement substantially exclusively in a horizontal direction and when so received automatically restrict the cylinder member axially in both vertical directions, and a can support on the base having a predetermined elevation relative to the cylinder support whereby, with the can coupled to the cylinder member, the can and cylinder member can be simultaneously received on their respective supports without interference.

2. Apparatus as set forth in claim 1, including means for varying the spacing between the can support and the cylinder member support to accommodate different can heights.

3. Apparatus as set forth in claim 2, wherein said can support is an adjustable shelf, said base including a plurality of support elements for supporting said shelf at different vertical heights.

4. Apparatus as set forth in claim 3, wherein said base includes vertical walls and said walls provide said support elements.

5. Apparatus as set forth in claim 1, wherein the can support can be withdrawn from a can supporting position when said can is coupled to the cylinder member and said cylinder member is supported on said cylinder member support to allow said can to be uncoupled from said cylinder member without removing said cylinder member from said cylinder support.

6. Apparatus for injecting material to be sprayed into an aerosol can containing a liquified propellent gas under pressure, said can having a discharge valve at the top thereof, said apparatus comprising a base adapted to support an aerosol can to be filled in a vertical position, a cylinder member adapted to be supported on said base, said cylinder member having a vertical pumping bore and a reduced diameter outlet adapted to be coupled to the discharge valve of a can disposed on the apparatus, means for coupling the reduced diameter outlet to said valve, a piston operable in said pumping bore, means for reciprocating said piston within said pumping bore, and a reservoir disposed above said pumping bore and in communication with the upper end thereof for supplying material to be injected into said aerosol can to said pumping bore, a lower portion of the piston clearing the top of the pumping bore when the piston is at an upper limit of its travel whereby material will flow by gravity from the reservoir into said pumping bore, the base including a support for the cylinder member, the cylinder member support being arranged to receive and release the cylinder member with the reservoir by relative movement in a horizontal direction and when so received automatically restrict the cylinder member axially in both vertical directions, and a can support on the base having a predetermined elevation relative to the cylinder support whereby, with the can coupled to the cylinder member, the can and cylinder member can be simultaneously received on their respective supports without interference, said vertical walls being formed of sheet metal and said support elements being apertures in said sheet metal.

7. Apparatus as set forth in claim 6, wherein portions of said shelf are arranged to be received in said apertures, said apertures and shelf being arranged such that said shelf is capable of tilting to increase the spacing between it and the cylinder member support at a side where a can is received and removed.

8. Apparatus for injecting material to be sprayed into an aerosol can containing a liquified propellent gas under pressure, said can having a discharge valve at the top thereof, said apparatus comprising a base adapted to support an aerosol can to be filled in a vertical position, a cylinder member adapted to be supported on said base, said cylinder member having a vertical pumping bore and a reduced diameter outlet adapted to be coupled to the discharge valve of a can disposed on the apparatus, means for coupling the reduced diameter outlet to said valve, a piston operable in said pumping bore, means for reciprocating said piston within said pumping bore, and a reservoir disposed above said pumping bore and in communication with the upper end thereof for supplying material to be injected into said aerosol can to said pumping bore, a lower portion of the piston being adjacent but clearing the top of the pumping bore when the piston is at an upper limit of its travel whereby material will flow by gravity from the reservoir into said pumping bore, said means for reciprocating said piston including a handle for manually operating the piston, the handle and piston being arranged to limit the upstroke of the piston by physical interference between the handle and a surface exterior of said pumping bore and reservoir.

9. Apparatus as set forth in claim 8, wherein the upstroke of the piston is limited by interference between the handle and a slot in the piston.

10. Apparatus as set forth in claim 8, wherein a limit to the downstroke of the piston is formed by physical interference between the handle and a slot in the piston.

11. Apparatus for injecting material to be sprayed into an aerosol can containing a liquified propellent gas under pressure, said can having a discharge valve at the top thereof, said apparatus comprising a base adapted to support an aerosol can to be filled in a vertical position, a cylinder member adapted to be supported on said base, said cylinder member having a vertical pumping bore and a reduced diameter outlet adapted to be coupled to the discharge valve of a can disposed on the apparatus, means for coupling the reduced diameter outlet to said valve, a piston operable in said pumping bore, means for reciprocating said piston within said pumping bore including a manually operated handle, and a reservoir disposed above said pumping bore and in communication with the upper end thereof for supplying material to be injected into said aerosol can to said pumping bore, a lower portion of the piston clearing the top of the pumping bore when the piston is at an upper limit of its travel whereby material will flow by gravity from the reservoir into said pumping bore, said base including a cabinet in the form of a rectangular parallelepiped, three sides of said cabinet being formed of a single sheet of steel, a sheet steel platform below said steel sheet cabinet, the lower edge of said steel sheet including depending tabs extending into and being retained in slots formed in said base platform, a pivot carried by the single sheet of steel for supporting said piston operating handle and sustaining pumping forces developed through said handle wherein said cabinet includes a door hinged on said single sheet of steel, said door forming a fourth side of said cabinet.

* * * * *

UNITED STATES PATENT AND TRADEMARK OFFICE

CERTIFICATE OF CORRECTION

PATENT NO. : 5,740,841
DATED : April 21, 1998
INVENTOR(S) : Donald J. Hirz

It is certified that error appears in the above-indentified patent and that said Letters Patent is hereby corrected as shown below:

Column 6, line 33 (claim 4, line 3), after "elements" insert --as formations at predetermined elevations--.

Signed and Sealed this

Eighteenth Day of August, 1998

Bruce Lehman

*Attest:*

BRUCE LEHMAN

*Attesting Officer*

*Commissioner of Patents and Trademarks*